United States Patent [19]

Saka et al.

[11] Patent Number: 4,897,042

[45] Date of Patent: Jan. 30, 1990

[54] MULTIPLE JUNCTION DEVICE

[75] Inventors: Youji Saka, Mie; Takao Nozaki, Tsu, both of Japan

[73] Assignee: Sumitomo Wiring Systems, Ltd., Japan

[21] Appl. No.: 207,316

[22] Filed: Jun. 15, 1988

[30] Foreign Application Priority Data

Jun. 16, 1987 [JP] Japan ..... 62-149832
Jun. 19, 1987 [JP] Japan ..... 62-154066

[51] Int. Cl.[4] ..... H01R 4/24
[52] U.S. Cl. ..... 439/404
[58] Field of Search ..... 439/395–419

[56] References Cited

U.S. PATENT DOCUMENTS 4,084,878 4/1979 Wahi ..... 439/400
4,697,862 10/1987 Hasircoglu ..... 439/404

*Primary Examiner*—Joseph H. McGlynn
*Attorney, Agent, or Firm*—Jordan B. Bierman

[57] ABSTRACT

A connection tab for making contact with an electric wire at a wire contact, having a connecting end remote therefrom, and being offset from the wire contact in a direction longitudinal of and/or perpendicular to the electric wire.

A junction device including a wiring board having a connection area and one or more electric wires to be connected. The wires are located beneath the wiring board and there is also provided one or more of the connection tabs. The junction device may have a plurality of wiring boards and the invention provides a very compact means for making a plurality of complex connections.

27 Claims, 6 Drawing Sheets

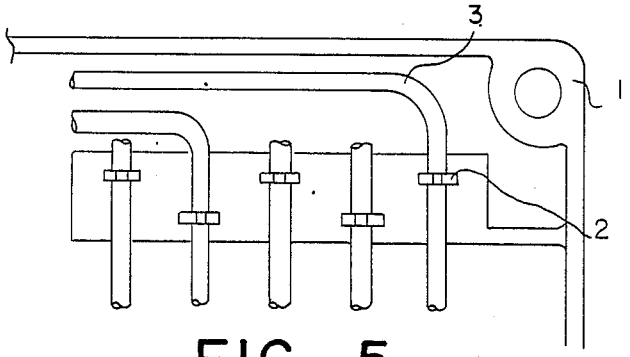
FIG. 5
FIG. 6
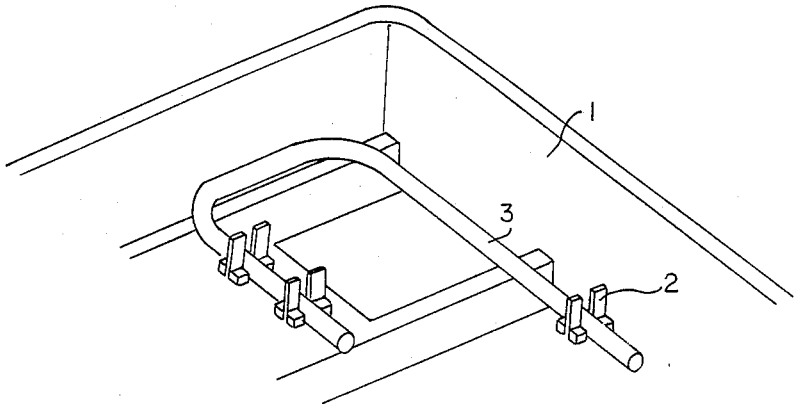

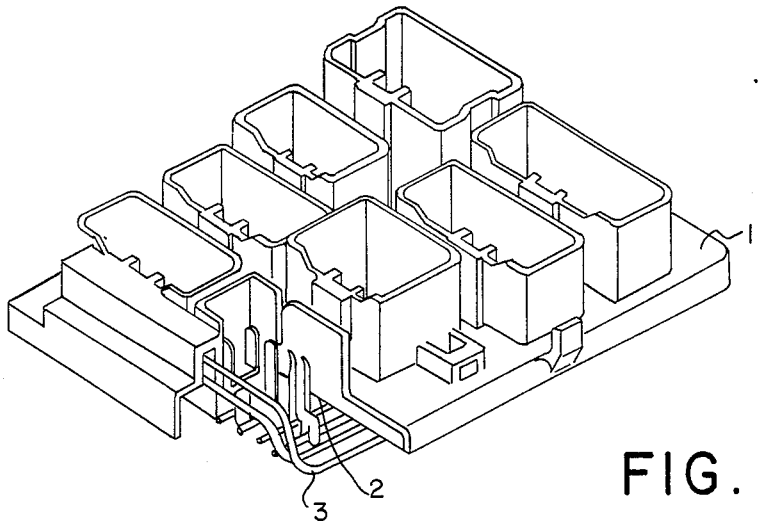
FIG. 7
FIG. 8
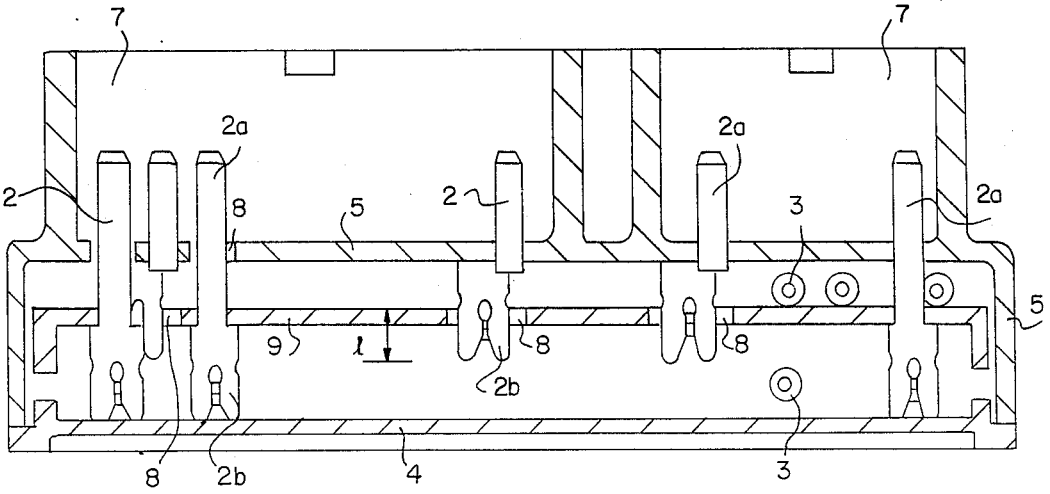

MULTIPLE JUNCTION DEVICE

This Application claims the priority of Japanese 149,832/87, filed June 16, 1987 and Japanese 154,066/87, filed June 19, 1987.

The present invention is directed to an improved form of junction box, more specifically, a device for making electrical contact within a circuit by means of an integrated unit. The device of the present invention is particularly adapted for use in the automotive field and has the ability to provide multiple contacts in a small volume.

THE PRIOR ART

In circuitry making use of electrical wires, the connections are usually made by means of certain devices which mate with one another and, if desired, are suitably releasable as needed. Such devices have been in common use in connection with automobiles but, as the complexity of the wiring has increased, a need has arisen for a connecting device which will be capable of handling a large number of individual connections in a very limited volume. Such devices provide a wiring board of one or more layers with an insulating layer of plastic therebetween. The necessary electrical terminals are, of course, also provided, along with a plastic housing or case.

Such devices frequently place the insulated wiring on the underside of the insulation board with a connection tab attached thereto. The lower tip of the connection tab grips the wire at a predetermined point and the other ends of the tabs are aligned rather precisely in order to be complementary to another mating connector.

The usual connection tab includes a relatively wide throat portion at the end adjacent the wires and it is intended that the wire conductor be squeezed against the throat so that its insulation is penetrated thereby and contact made therewith. It is, therefore, necessary in the prior art devices to leave substantial space between the connection tabs to provide for the foregoing contact and to leave sufficient room for the wires being connected. As a result, the prior art devices, especially if they are to handle a substantial plurality of wires, are excessively bulky.

SUMMARY OF THE PRESENT INVENTION

It is an object of the present invention to produce a junction device having multiple layers capable of making connections between a large number of individual wires. It is also among the objects of the present invention to provide a device of the foregoing capability in a small volume. It is further an object of the present invention to utilize a connection tab having a throat for contact with the wire at one end and a mating member for use with another electrical connector at the other end.

In achieving the foregoing objects, there is provided a connection tab having a wire contact and a connecting end remote therefrom. The connecting end and the wire contact are offset from each other in a direction longitudinal of and/or perpendicular to the electric wire.

The wire contact is made up of a pair of prongs having a throat therebetween which preferably tapers away from its opening. It is also preferable that at least one edge of the throat constitute a cutting blade which is adapted to penetrate insulation on the wire and make electrical contact therewith.

The Invention also comprises a junction device having a first wiring board with one or more connection areas mounted thereon. There is at least one electrical wire beneath the first wiring board and a corresponding number of the aforesaid connection tabs. Usually, there is a plurality of such wires, each of which is to be connected. In a preferred form of the device, the wire contacts of the tabs extend through the first board and are retained within grooves in an outer casing.

In a more complex form of the device, there is at least a second wiring board beneath the first wiring board and insulated therefrom. In addition to the wiring beneath the first board, there is wiring beneath the second board. Further connection tabs are provided which extend into the connection areas and pass through the first board and the second board to extend into the space between the second board and the outer casing. In this way, it is possible to compress a substantial number of connectors in a small unit. Here, too, the casing is preferably grooved to receive the ends of the tabs.

The nature of the connection tabs also assists in achieving this desired result. Such tabs preferably have a generally flatened shape and the wire contact end is offset from the connecting end. Such offset can be longitudinally of the wire being held, perpendicular thereto, or both. This permits adjusting the positions of the members gripping the wire and the wires themselves to avoid unwanted interference, while, at the same time, maintaining the connecting ends of the tabs in appropriate alignment for mating with another connector.

The nature of the wires used is not particularly critical; e.g. they can be single conductor or twisted, with or without insulation. However, the device is particularly intended for use with insulated, single conductor, hard copper wiring.

BRIEF DESCRIPTION OF THE DRAWINGS

In the accompanying drawings, constituting a part hereof, and in which like reference characters indicate like parts.

FIGS. 5 to 7 are schematic views of fragments of various wiring boards or panels according to the present invention;

FIG. 8 is a cross sectional view of an assembled device according to the present invention.

DETAILED DESCRIPTION OF THE INVENTION

Figure 1:
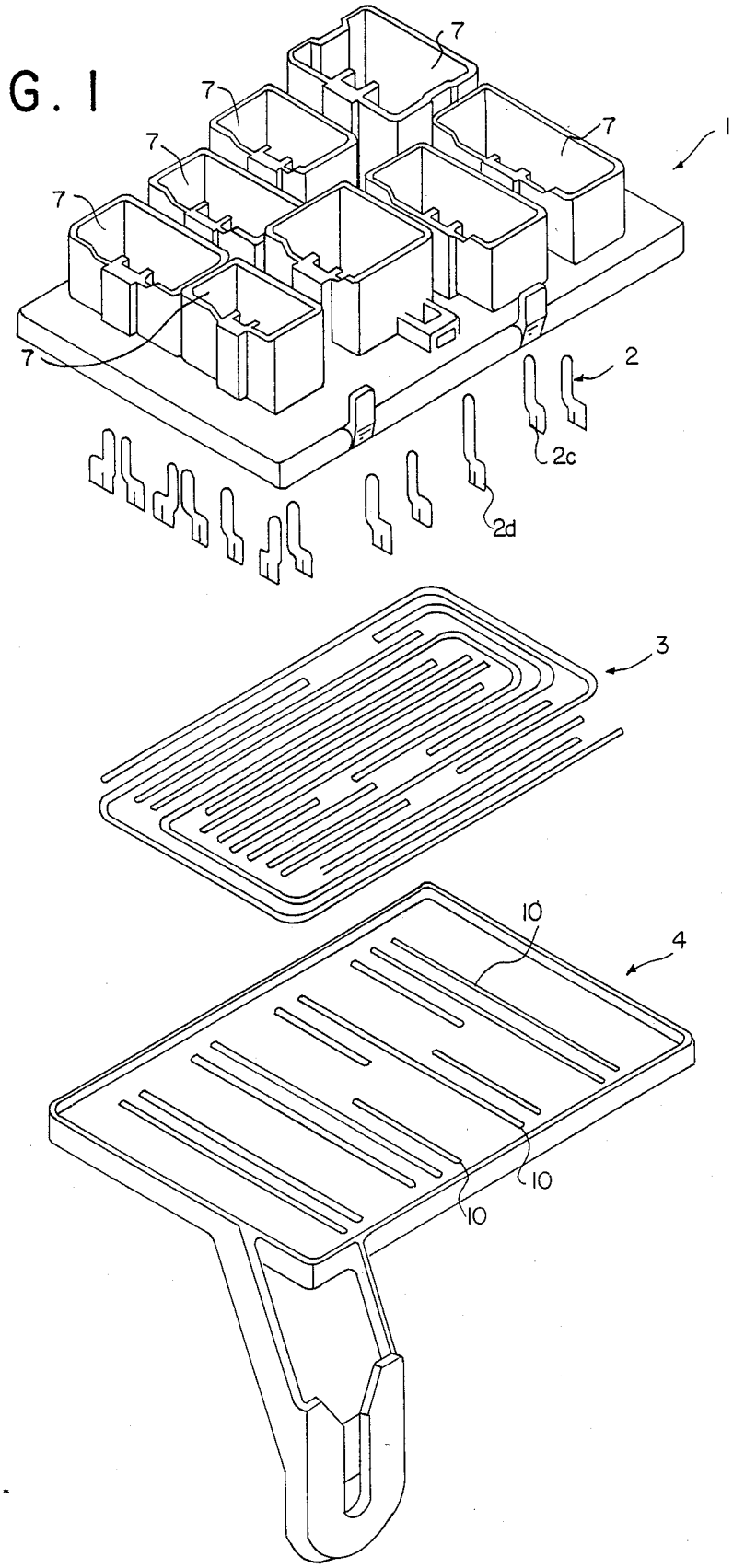
FIG. 1 is an exploded view, partly schematic, of a single-layered device according to the present invention.

Referring specifically to FIG. 1, first wiring board 1 carries a plurality of connecting areas 7 thereon. A plurality of connection tabs 2 is also provided. Electrical wires 3 are located on the underside of board 1 and contact is made therewith through tabs 2, and bottom casing 4 with grooves 10 completes the device.

Figure 2:
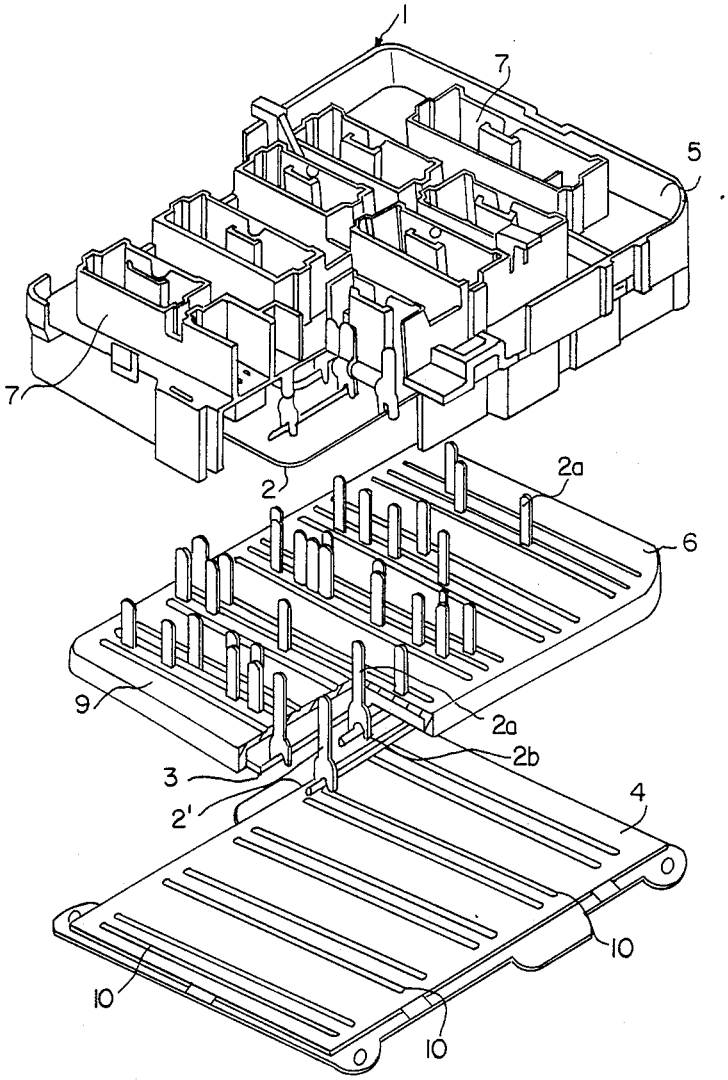
FIG. 2 is a view, similar to that of FIG. 1, of a form of the device having two layers.

A multi layered device is shown in FIG. 2. In addition to first wiring board 1, second wiring board 6 is located between casing 4 and first wiring board 1. Additional wires 3 are held on the underside of board 6, in a manner similar to the embodiment of FIG. 1. Tabs 2 extend from wires 3 through boards 6 and 1 to project into connecting areas 7. The opposite ends of tabs 2 project partially into grooves 10 in casing 4.

Figure 3:
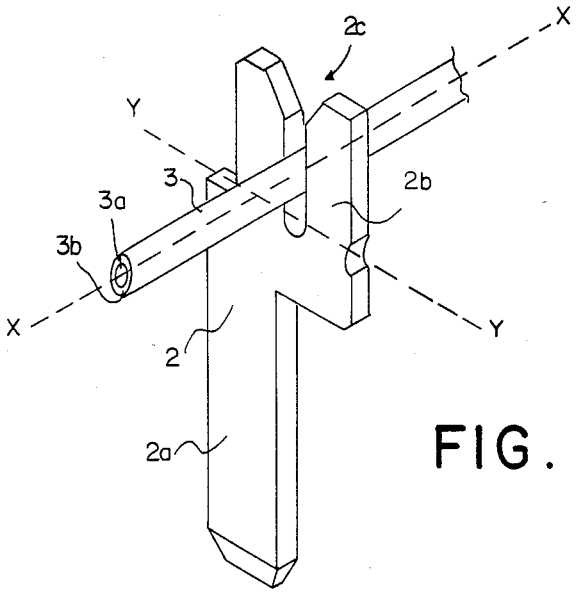
FIG. 3 is an enlarged diagrammatical view of a tab according to the present invention which is offset in a direction perpendicular to the wire.
Figure 4:
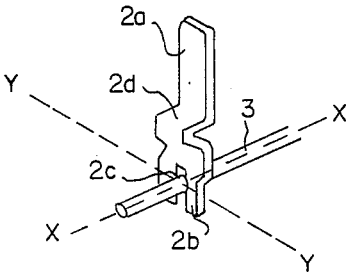
FIG. 4 is a view similar to that of FIG. 3 wherein the connecting end is offset in a direction both longitudinal of and perpendicular to the wire.

The nature of the tabs is shown more clearly in FIGS. 3 and 4. Tabs 2 comprise connecting end 2*a* and a pair of prongs 2*b*. Prongs 2*b* are spaced apart to form throat 2*c* through which wire 3 is inserted. Wire 3 is in the usual form having center conductor 3*a* and insulating layer 3*b*.

As is shown in FIG. 3, connecting end 2*a* is offset from prongs 2*b* and throat 2*c* in a direction perpendicular to wire 3. In FIG. 4, a similar device is shown with prong 2*b* and throat 2*c* offset in a direction longitudinal of and perpendicular to wire 3. This is accomplished by providing bend 2*d* in tab 2.

In the device of FIGS. 5 to 7, the wire contacts of tab 2 are staggered in their arrangement in the device. However, the connecting ends, due to the offsets of tabs 2, are fully aligned so that they are adapted to mate with another connector (not shown).

Referring more particularly to FIG. 8, wire contact 2*b* located in wiring board 6 is held on insulation board 9 through slit 8. Wire contact 2*b* used for wiring board 1 also passes through insulation board 9 and rests on bottom casing 4.

Figure 9:
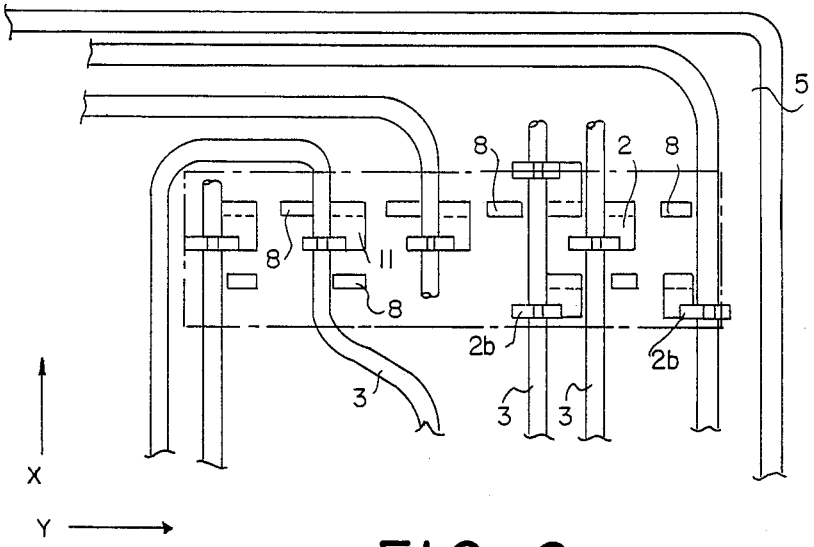
FIG. 9 is a view of the underside of the wiring board of FIG. 1.

FIG. 9 is a fragmentary, schematic bottom view of wiring board 1. Wires 3 are aligned on one axis and slits 8 are aligned on another axis in order to best achieve the benefits of the present invention. Thus, by the various offsets of the connection tabs, it is possible to locate the wires more efficiently without giving up the ability to have the connecting ends of the tabs in an appropriate simple alignment for engagement with another connector.

Although only a limited number of specific embodiments of the present invention have been expressly disclosed, it is, nonetheless, to be broadly construed and not to be limited except by the character of the claims appended hereto.

What we claim is:

1. A junction device comprising a first wiring board having at least one connection area thereon, at least one first electric wire to be connected, said first wire being beneath said first wiring board, and at least one first connection tab;

each said first connection tab comprising a first connecting end and a first wire contact remote therefrom, said connecting end being offset from said first wire contact in a direction longitudinal of said first wire;

said first connecting end being adapted to mate with a complementary portion of another connector, each said first tab extending from said wire connection area through said first wiring board and being in electrical contact with one said first electric wire.

2. The device of claim 1 wherein each said first wire contact is offset from each said first connecting end perpendicular to said first electric wire.

3. The device of claim 1 wherein said first wire contact comprises a pair of first prongs having a first throat therebetween, at least one edge of said throat adapted to penetrate insulation on said first electric wire to make electrical contact therewith.

4. The device of claim 1 wherein there are a plurality of said first electrical wires and a plurality of said first connector tabs.

5. The device of claim 1 wherein at least one slit is provided in said first wiring board through which each said first tab passes.

6. The device of claim 1 comprising a second wiring board beneath said first wiring board and insulated therefrom, at least one second electrical wire to be connected, said second wire being beneath said second wiring board, and at least one second connecting tab;

each said second connection tab comprising a second connecting end and a second wire contact remote therefrom, said second connecting end adapted to mate with a second complementary portion of another connector, each said second tab extending from said connection area through said second board and in electrical contact with said second electric wire.

7. The device of claim 6 wherein said second wire contact comprise a pair of second prongs having a second throat therebetween, at least one edge of said second throat adapted to penetrate insulation on said second electric wire to make electrical contact therewith.

8. The device of claim 6 wherein there are a plurality of said first electrical wires, a plurality of said first connector tabs, a plurality of said second electrical wires, and a plurality of said second connector tabs.

9. The device of claim 6 wherein at least one slit is provided in each of said first wiring board and said second wiring board, each said second tab passing through said first slit and said second slit.

10. The device of claim 1 comprising a casing beneath said first wiring board, at least one groove in said casing, at least one said first connection tab partially extending into said groove.

11. The device of claim 10 wherein at least one first slit is provided in said first wiring board through which each said first tab passes.

12. The device of claim 6 comprising a casing beneath said second wiring board, at least one groove in said casing, at least one said second connection tab extending partially into said groove.

13. The device of claim 12 wherein at least one said first connection tab partially extends into said groove.

14. A junction device comprising a first wiring board having at least one connection area thereon, at least one first electric wire to be connected, said first wire being beneath said first wiring board, and at least one first connection tab;

each said first connection tab comprising a first connecting end and a first wire contact remote therefrom, said connecting end being offset from said first wire contact in a direction perpendicular to said first wire;

said first connecting end being adapted to mate with a complementary portion of another connector, each said first tab extending from said connection area through said first wiring board and being in electrical contact with one said first electric wire.

15. The device of claim 14 wherein each of said first wire contact is offset from each said first connecting end longitudinally from said first electric wire.

16. The device of claim 14 wherein said first wire contact comprises a pair of first prongs having a first throat therebetween, at least one edge of said throat adapted to penetrate insulation on said first electric wire to make electrical contact therewith.

17. The device of claim 14 wherein there are a plurality of said first electrical wires and a plurality of said first connector tabs.

18. The device of claim 14 comprising a second wiring board beneath said first wiring board and insulated thereform, at least one second electrical wire to be connected, said second wire being beneath said second wiring board, and at least one second connection tab;

each said second connection tab comprising a second connecting end and a second wire contact remote therefrom, each said second wire contact being offset from each said connecting end longitudinally from said second electric wire.

19. The device of claim 18 wherein each said electric wire contact is offset from each second connecting end perpendicular to said second wire.

20. The device of claim 18 wherein said second wire contact comprises a pair of second prongs having a second throat therebetween, at least one edge of said second throat adapted to penetrate insulation on said second electric wire to make electrical contact therewith.

21. The device of claim 18 wherein there is a plurality of said first electrical wires, a plurality of said first connector tabs, a plurality of said second electrical wires, and a plurality of said second connector tabs.

22. The device of claim 18 wherein at least one slit is provided in said first wiring board through which each said first tab passes.

23. The device of claim 18 wherein at least one first slit is provided in said first wiring board and at least one second slit is provided in said second wiring board, each said second tab passing through said first slit and said second slit.

24. The device of claim 18 comprising a casing beneath said second wiring board, at least one groove in said casing, at least one said second connection tab extending partially into said groove.

25. The device of claim 18 comprising a casing beneath said first wiring board, at least one groove in said casing, at least one said first connection tab partially extending into said groove.

26. The device of claim 25 wherein at least one first slit is provided in said first wiring board through which each said first tab passes.

27. The device of claim 26 wherein at least said first connection tab partially extends into said groove.

* * * * *